US005123129A

United States Patent [19]

Lyons

[11] Patent Number: 5,123,129

[45] Date of Patent: Jun. 23, 1992

[54] WATERPROOF HINGED PANEL ASSEMBLY

[76] Inventor: Donald D. Lyons, 204 West Telegraph, Dowagiac, Mich. 49047

[21] Appl. No.: 523,061

[22] Filed: May 14, 1990

Related U.S. Application Data

[62] Division of Ser. No. 230,850, Aug. 10, 1988, Pat. No. 4,953,261.

[51] Int. Cl.[5] ..... A47K 3/02

[52] U.S. Cl. ..... 4/557; 4/607; 4/609; 160/273; 160/117

[58] Field of Search ..... 4/557, 607, 609, 610; 160/117, 196.1, 199, 210, 213

[56] References Cited

U.S. PATENT DOCUMENTS

| | | | |
|---|---|---|---|
| 2,032,180 | 2/1936 | McCord | 4/581 |
| 2,048,909 | 7/1936 | Woodworth | 160/210 X |
| 2,293,726 | 8/1942 | Fitch et al. | 160/210 |
| 2,747,200 | 5/1956 | Finkel | 4/557 |
| 2,885,000 | 5/1959 | Merrill | 160/199 X |
| 3,111,208 | 11/1963 | Grossman | 4/610 X |
| 3,335,784 | 8/1967 | Risk et al. | 160/199 |
| 4,276,919 | 7/1981 | Walters | 4/607 X |
| 4,878,530 | 11/1989 | Jean | 160/213 X |

FOREIGN PATENT DOCUMENTS

| | | | |
|---|---|---|---|
| 0283236 | 9/1988 | European Pat. Off. | 4/607 |
| 2911967 | 10/1980 | Fed. Rep. of Germany | 4/607 |
| 2943122 | 5/1981 | Fed. Rep. of Germany | 4/607 |

*Primary Examiner*—Charles E. Phillips
*Attorney, Agent, or Firm*—Fitch, Even, Tabin & Flannery

[57] ABSTRACT

Shower stall and bathtub enclosure door assemblies which use a hinged multipanel door design, with special waterproof hinges and seams, adjustable wall panels retained by waterproof mounting sheaths, and door panel deflector sections with corresponding deflector shields to deflect water which collects on the inner surfaces of the door panels, and a door closure system which firmly secures the doors when the door assembly is closed.

6 Claims, 3 Drawing Sheets

WATERPROOF HINGED PANEL ASSEMBLY

This is a division of application Ser. No. 230,850, filed Aug. 10, 1988, now U.S. Pat. No. 4,953,261.

BACKGROUND OF THE INVENTION

The present invention relates to hinged enclosure panel assemblies, and more particularly to waterproof hinged door assemblies for shower stalls and bathtub alcoves.

Door assemblies that are commonly in use for shower stalls and bathtub enclosures generally require the use of door tracks above and below the doors which extend from one vertical wall support bracket along one wall of the stall or enclosure to the other wall support bracket along the opposite wall. The upper and lower door tracks are required to prevent the weight of the doors from pulling the vertical support brackets for the doors away from the wall, as well as to provide guide channels for the doors to keep them in alignment as they open. These door assemblies generally require such bracing and support because they include heavy tempered glass door panels, which also dictate heavy hinging and latching systems. Furthermore, the lower door track is usually necessary for sealing the bottom edge of the door assembly, since glass paneled doors cannot generally conform to the contour of stall or alcove installations.

However, assemblies with upper and lower door tracks require custom fitting of the door assembly to the shower stall or tub alcove. Furthermore, the doors or the vertical support brackets on the wall require custom sizing during fabrication or installation so that the assembly can be completely sealed when closed. Door assemblies with lower door tracks are also undesirable because they tend to collect dirt and pools of water. Also, with sliding doors, the entrance to the stall or alcove is restricted in size due to the amount of space required for the sliding panel or panels in their open position.

With the adoption of lightweight materials for such door assemblies, it has been possible to eliminate the upper and lower door tracks and rely upon the security of the vertical wall support brackets alone for support of the door assembly. Such door assemblies may rely upon ordinary drywall anchors for support. However, the door assemblies which are now in use which have dispensed with the door tracks rely upon close fitting or overlapping door panels for resistance to water seepage. Some such door assemblies also include lower door sections which bend inwardly to deflect the water spray which collects on them into the shower stall or bathtub.

All of the trackless door systems have poor water sealing performance, and their overlapping panel designs restrict their ability to remain closed. Yet, the overlapping panel design is necessary on such door assemblies, both to achieve a relatively water resistant partition and to allow such door assemblies to be designed for a wide range of shower stall and bathtub enclosure openings without custom fitting.

OBJECTS OF THE INVENTION

Accordingly, one object of the present invention is to secure a watertight trackless shower stall or bathtub alcove door assembly.

Another object of the present invention is to secure a universally adjustable shower stall or bathtub alcove door assembly.

Yet another object of the present invention is a shower stall or bathtub alcove door assembly which has a large entrance.

Still another object of the invention is to secure a lightweight shower stall or bathtub alcove door assembly which is supportable by ordinary drywall anchors.

A further object of the invention is to secure a shower stall or bathtub alcove door assembly which opens and closes securely.

SUMMARY OF THE INVENTION

The present invention achieves the above stated objects, as well as other advantages described herein, by means of a shower stall or bathtub alcove door assembly which uses a hinged multipanel door design, with special waterproof hinges and seams, adjustable wall panels retained by waterproof mounting sheaths, and door panel deflector sections with corresponding deflector shields to deflect water which collects on the inner surfaces of the door panels into the shower stall or bathtub enclosure without seepage, and a door closure system which firmly secures the doors when the door assembly is closed.

The waterproof hinges have special watertight edge surfaces which mate when the door assembly is closed. These watertight surfaces include magnetically attractive sealing strips which seal and secure the door assembly when it is closed. The door panel deflector sections are angled inwardly to deflect water, and the edges of the wall mounting panel deflector shields conform to the deflector sections when the door assembly is closed to prevent seepage.

Other advantages and features of the present invention are described in connection with the preferred embodiment described herein.

DESCRIPTION OF THE PREFERRED EMBODIMENTS

The present invention is adaptable as a watertight partition for both shower stalls and bathtub enclosures, and it is easily adjusted to fit a wide range of openings for either use.

Figure 1:
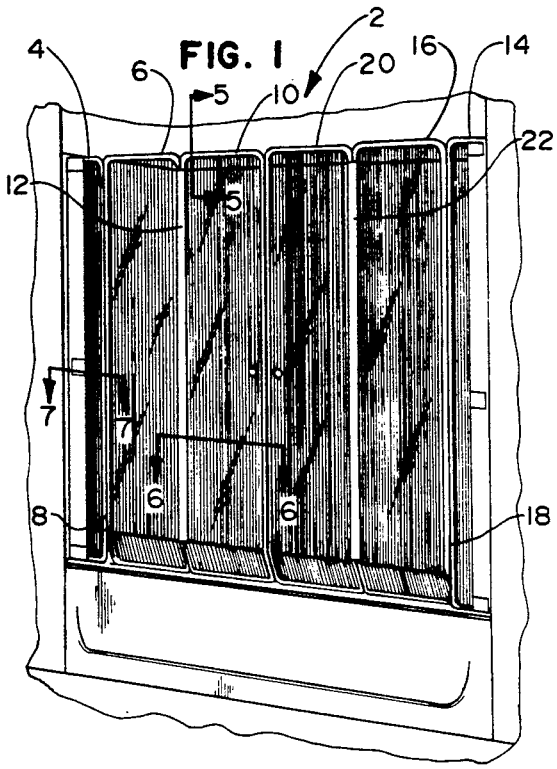
FIG. 1 is a preferred embodiment of a door assembly for a bathtub alcove according to the present invention shown in the closed position.
Figure 2:
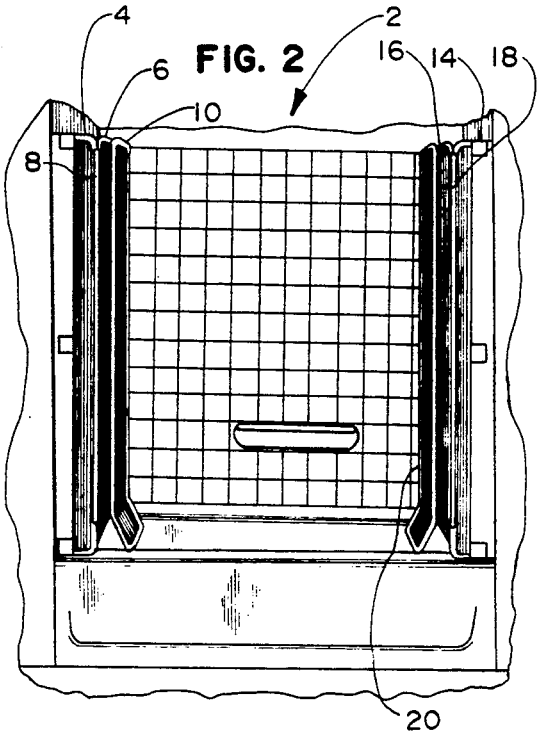
FIG. 2 is the embodiment of FIG. 1 shown in the open position.

Referring to the drawings, wherein reference characters designate like or corresponding parts throughout the views, FIG. 1 shows a preferred embodiment of the present invention adapted for a bathtub alcove, depicted in the closed position. A door assembly 2 includes a left support panel 4, a first left door panel 6 hinged to said left support panel 4 with a hinge 8, a second left door panel 10 hinged to the first left door panel 6 with a hinge 12, a right support panel 14 hinged to a first right door panel 16 with a hinge 18, and a second right door panel 20 hinged to the first right door panel 16 with a hinge 22. FIG. 2 shows the door assembly 2 in the open position.

Figure 3:
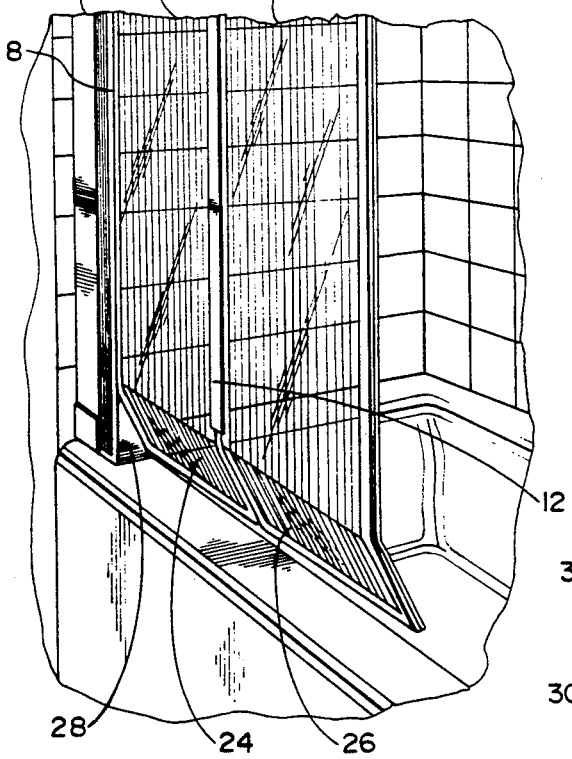
FIG. 3 is a detailed view of the left side section of the embodiment of FIG. 1, shown in the closed position.

FIG. 3 is a detailed view of the left side of the door assembly 2, including the left door support panel 4, the first left door panel 6 and the second left door panel 10, shown in the closed position The first left door panel 6 has a first left door deflector section 24 and the second left door panel 10 has a second left door deflector section 26. The first left door deflector section 24 and the second left door deflector section 26 are inwardly bent sections of the first left door panel 6 and second left door panel 10 respectively, having a sufficient inward deflection to have bottom edges of the left door deflector sections 24, 26 inside the tub when the door assembly 2 is closed. These left door deflector sections 24, 26 serve to direct water which sprays on the left door panels 6, 10 to flow into the tub. Of course, the left door deflector sections 24, 26 need not be linear sections as shown, and they can alternately have radii of curvature, or similar profile, so long as their bottom edges extend inwardly into the tub.

A left door support panel deflector shield 28 extends inwardly from the edge of the left door support panel 4 along its lower extremity to substantially fill the gap between the edge of the left door support panel 4 and the first left door deflector section 24. This shield 28 can be a molded section of the left support panel 4 extending inwardly or a separate piece attached to the left support panel 4. In any case, the inner edge of the left deflector shield 28 conforms to the profile of the first left door deflector section 24 when the door assembly 2 is closed. Consequently, the left deflector shield 28 prevents water from splashing out of the tub between the left door support panel 4 and the first left door deflector section 24.

Figure 4:
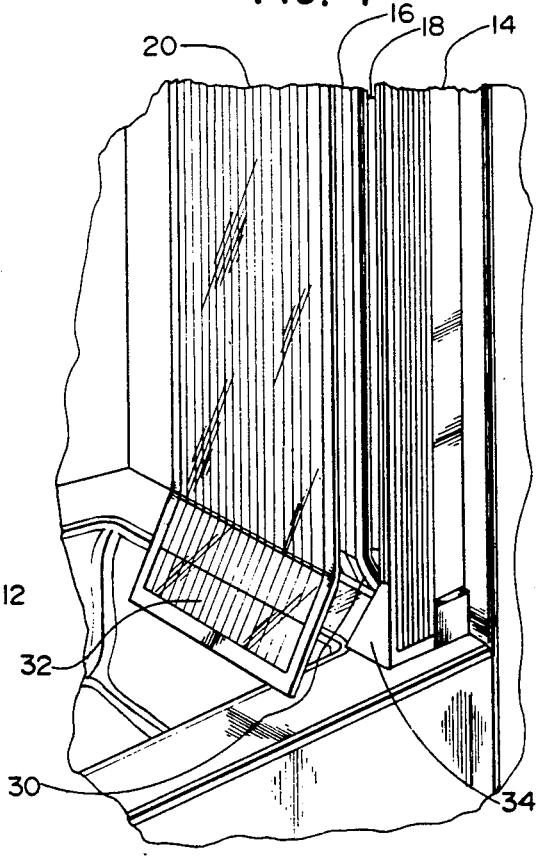
FIG. 4 is a detailed view of the right side section of the embodiment of FIG. 1, shown in the open position.

FIG. 4 is a detailed view of the right side of the door assembly 2, including the right door support panel 14, the first right door panel 16 and the second right door panel 20, shown in the open position. The first right door panel 16 has a first right door deflector section 30 and the second right door panel 20 has second right door deflector section 32. The first right door deflector section 30 and the second right door deflector section 32 are inwardly bent sections of the first right door panel 16 and the second right door panel 20 respectively, having a sufficient inward deflection to have bottom edges of the right door deflector sections 30, 32 inside the tub when the door assembly 2 is closed, just as described above for the left door deflector sections 24, 26.

A right door support panel deflector shield 34 extends inwardly from the edge of the right door support panel 14 along its lower extremity to substantially fill the gap between the edge of the right door support panel 14 and the first right door deflector section 30 when the door assembly 2 is in the closed position, just as described above for the left door support panel deflector shield 28.

The right door support panel 14 is hinged to the first right door panel 16 with the hinge 18 to let the first right door panel 16 swing inwardly into the tub, so that in the open position it is proximate the right wall of the bathtub alcove, as shown in FIG. 3. The second right door panel 20 is hinged to the first right door panel 16 with the hinge 22 to let the second right door panel swing outwardly out of the tub relative to the first right door panel 16, so that in the open position the second right door panel 20 is proximate the first right door panel 16 along the right wall of the bathtub alcove, as shown in FIG. 3. With this hinging configuration, the right door panels 16, 20 swing aside to allow almost the entire right side of the bathtub alcove for entrance. This hinging configuration also orients the right door deflector sections 30, 32 to face in opposite directions when their respective right door panels 16, 20 are folded in the open position, so that they do not interfere with each other when the doors assembly 2 is opened, thereby allowing maximum clearance in the open position.

Likewise, the left door support panel 4 is hinged to the first left door panel 6 with the hinge 8 to let the first left door panel 6 swing into the tub, and the second left door panel 10 is hinged to the first left door panel 6 with the hinge 12 to let the second left door panel swing outwardly out of the tub relative to the first left door panel 6, just as described for the right door panels 16, 20 described above. Similarly, in the open position, the left door panels 6, 10 swing open to allow almost the entire left side of the bathtub alcove for entrance, as shown in FIG. 2.

Although the door support panels 4, 14 and the door panels 6, 10, 16, 20 may be fabricated of any convenient panel material, a panel material which is both light weight and rigid is most desirable, since a trackless configuration exerts its weight at the door support panels 4, 14 away from their respective bathtub alcove walls. An ideal material for his purpose is cellular plastic sheet stock, such as General Electric Lexan Thermoclear Sheet. The cellular structure of this plastic sheet stock is very rigid even though it is light weight. However, the use of such cellular sheet stock requires that the edges be properly sealed to prevent accumulation of moisture within the cellular structure.

Figure 5:
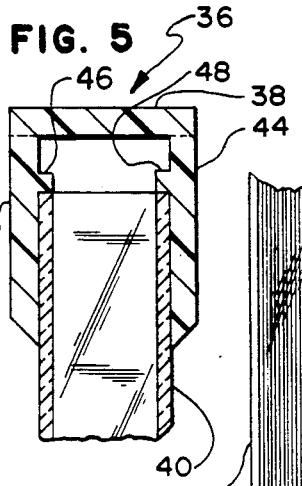
FIG. 5 is a cross sectional view of one of the door panel upper edge seals according to the cross section indicated in FIG. 1 along line 5—5.
Figure 6:
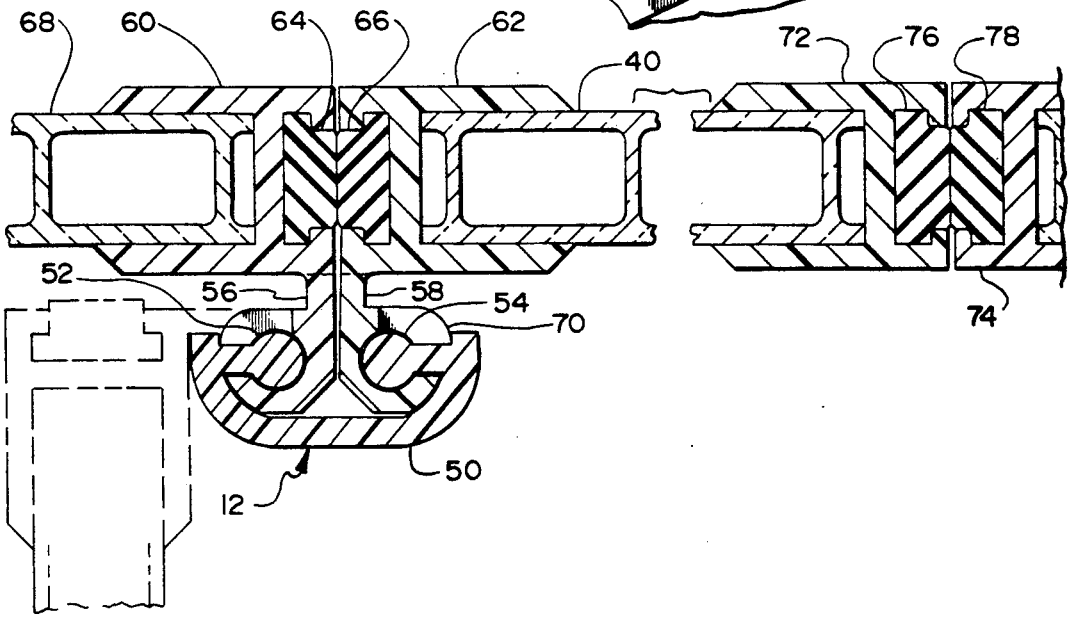
FIG. 6 is a cross sectional view of the hinge assembly and door panel engagement assembly according to the cross section indicated in FIG. 1 along line 6—6.

FIG. 5 is a cross sectional view of the upper edge of the second left door panel 10 shown in FIG. 1, and is representative of the upper and lower edges for the door support panels 4, 14 and the door panels 6, 10, 16, 20. A linear edge channel 36 includes an edge section 38, which is substantially transverse to the surfaces of a second left door panel sheet 40, and two side sections 42, 44 which closely conform to the surfaces of the second left door panel 10. Thus, the end of the door panel 10 is completely sealed by the edge channel 36. Additionally, edge stops 46, 48 can be added to the side sections 42, 44 to provide any desired degree of protrusion of the edge section 38 away from the panel sheet 40. Although the edge channel 36 may be fabricated from component sections, it is most conveniently a single molded or extruded plastic piece FIG. 6 is a cross sectional view of the side edge of the second left door panel 10, the hinge 12, and the proximate edges of the first left door panel 6 and the second right door panel 20, as indicated in FIG. 3. The view of the hinge 12 is also representative of the hinges 8, 18 and 22 in cross section. The hinge 12 includes a linear hinge channel 50 with linear rounded end protrusions 52, 54 along both sides of the interior of the hinge channel 50. A first hinge projection member 56 and a second hinge projection member 58 are coupled together and restricted in motion by the linear channel 50 because the projection members 56, 58 each have edges with linear sockets on one side which engage the rounded ends of the linear projections 52, 54, and bearing surfaces on the inner sides of the hinge projection members 56, 58 which engage each other and the inner perimeter of the hinge channel 50 to restrict the motion of each of the hinge projection members 56, 58 about their corresponding linear protrusions 52, 54. This rotational movement is depicted by the dotted outline of the hinge 12 in FIG. 6. The bearing surfaces on the hinge projection members 56, 58 may each include at least one longitudinal facet to provide a convenient stop position for the hinge assembly. The hinge projection members 54, 56 each are shown with two longitudinal facets in FIG. 6, one for a half open position and the other for a full open position. Alternately, more facets can be provided for intermediate stop positions. Likewise, the bearing surfaces can be completely smooth and curvilinear, or may include longitudinal meshing teeth. Door panel attachment channels 60, 62 extend at right angles to their corresponding hinge projection members 56, 58 to permit linear sealing strips 64, 66 to seal with each other when the hinge 12 is in the closed position, thus assuring a watertight fit. The attachment channels 60, 62 conform to their corresponding door panel sheets, the second door panel sheet 40 described above, and a first door panel sheet 68, as described above for the edge channel 36 in connection with FIG. 5. The sealing strips 64, 66 may be any convenient sealing material, but preferably a magnetically attractive material to hold them together when they butt together, such as magnetized rubber, and may be fastened in corresponding grooves in the attachment channels 60, 62 as shown in FIG. 6, or they may simply be applied on the butting surfaces of the attachment channels 60, 62. To prevent the axial movement of the hinge channel 50 along the hinge projections 56, 58, a hinge bearing plate 70 is laterally inserted into a conforming slot cut into and through the hinge channel 50 and the hinge projections 56, 58. The bearing plate 70 maintains alignment of the hinge channel 50 with the hinge protrusions 56, 58 without affecting the operation of the hinge 12.

Also shown in FIG. 6 are door closure channels 72, 74 which extend along the edges of the second left door panel 10 and the second right door panel 20 butted against each other when the door assembly 2 is closed. Closure strips 76, 78 extend along the butting sides of the closure channels 72, 74 and they may be of any convenient sealing material, but preferably a magnetically attractive material to hold them together when they butt together, such as magnetized rubber. The closure strips 76, 78 may be fastened in corresponding grooves in the closure channels 72, 74, or they may simply be applied to the butting surfaces of the closure channels 72, 74.

Figure 7:
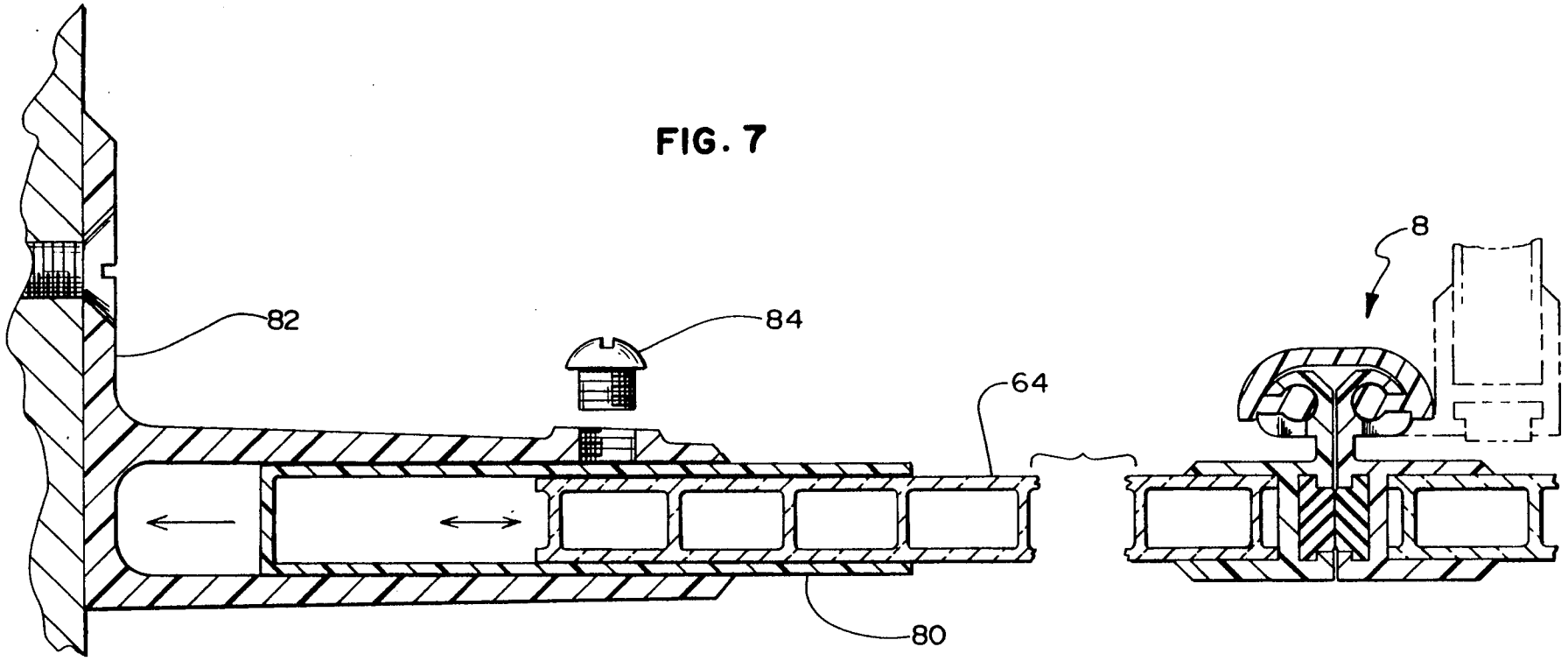
FIG. 7 is a cross sectional view of the support panel attachment assembly according to the cross section indicated in FIG. 1 along line 7—7.

FIG. 7 is a cross sectional view of a portion of the left door support panel 4 shown in FIG. 1. A left wall sealing sheath 80 fits over the edge of the first left door panel sheet 68 described above in connection with FIG. 6. The left wall sealing sheath 80 is positioned to butt against the left wall of the bathtub alcove. The first left door panel sheet 68 is then slid within the left wall sealing sheath 80 to a desired position for best overall door panel alignment. The left wall sealing sheath 80 is fastened by at least one wall mounting bracket 82, which clamps the sheath 80 to the door panel sheet 68 with, for instance, a clamping screw 84, and serves as a mounting surface for bolting or otherwise fastening the door assembly 2 to the wall of the bathtub alcove. For convenience, each wall mounting bracket 82 may be first fastened to the alcove wall, and then the sheath 80 positioned to butt against each mounting bracket 82 and the alcove wall together. The sheath 80 may include notches along its wall butting edge for clearance around each wall mounting bracket 82. The left wall sealing sheath 80 permits the left door support panel 4 to have an adjustable width to permit the door assembly 2 to be mounted in a variety of bathtub alcove widths without modification. The right wall support panel 14 also has a sealing sheath fitting over a panel sheet, so both the door support panels 4, 14 may be adjusted in width to provide an even greater range of bathtub alcove widths.

Figure 8:
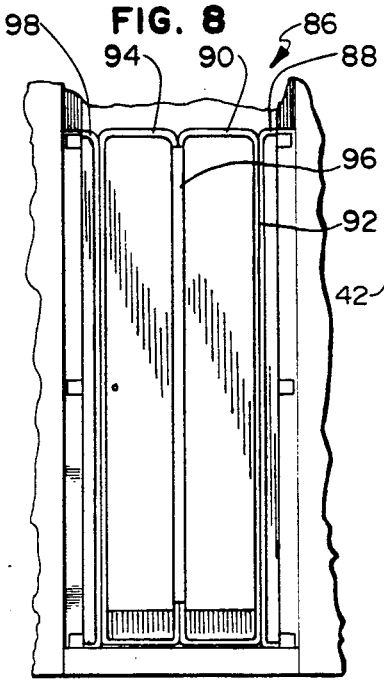
FIG. 8 is an alternative embodiment of a door assembly for a shower stall according to the present invention shown in the closed position.
Figure 9:
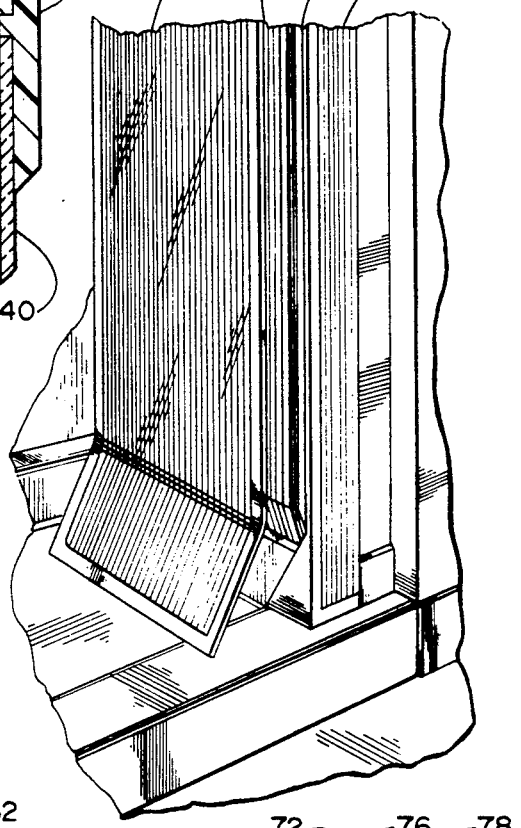
FIG. 9 is a detailed view of the alternative embodiment of FIG. 8 shown in the open position.

FIG. 8 shows an alternate embodiment of the invention adapted for a shower stall in the closed position. Because a shower stall is relatively narrow, a single door is sufficient to enclose the stall. Therefore, only a single left or right side of the door assembly 2 as described above need be used. A shower stall door assembly 86 includes a shower door support panel 88, a first shower door panel 90 hinged to said shower door support panel 88 with a hinge 92, a second shower door panel 94 hinged to the first shower door panel 90 with a hinge 96, and a shower closure panel 98 which has an inner edge which engages the inner edge of the second shower door panel 94 when the shower door assembly 86 is in the closed position. The shower support panel 88, the shower door panels 90, 94 and the hinges 92, 96 are exactly as described above for the corresponding right door components of the door assembly in connection with FIG. 1. The shower closure door panel 98 is similar to the left door support panel 4 described above, except it has a closure channel (not shown) along its inner edge similar to the closure channels 72, 74 described above, instead of the hinge 8. FIG. 9 shows the shower stall door assembly 84 in the open position.

It will be understood that various changes in the details, materials and arrangement of parts and systems which have been herein described and illustrated in order to explain the nature of the invention may be made by those skilled in the art within the principle and scope of the invention as expressed in the appended claims.

What is claimed is:

1. A waterproof hinged door assembly for a bathtub alcove having left and right door panel assemblies which hingedly close together, each of said door panel assemblies having corresponding and respective inward and outward surfaces, and each of said door assemblies comprising:

a door support panel including a wall mounting sheath surrounding a wall mounting side to said door support panel for providing an adjustable mounting width for said door support panel;

a first door panel including a first hinge for hingedly coupling said first door panel with said door support panel to swing inwardly relative to said door support panel; and a second door panel including a second hinge for hingedly coupling said second door panel with said first panel to swing outwardly relative to said first door panel;

said first and second door panels each including inwardly protruding lower spray deflector sections with bottom edges extending over a bathtub side when said door assembly is closed, each said door support panel including a spray deflector shield extending from an edge of each said door support panel adjacent to said spray deflector sections inwardly to approximate the surface of each spray deflector section when said door assembly is closed.

2. The door assembly recited in claim 1, wherein each of said door support panels and said first and second panels include a sealing strip along each of its butting surfaces.

3. The door assembly recited in claim 2, wherein said sealing strips are magnetically attractive.

4. A waterproof hinged door panel assembly for a shower stall alcove, said door panel having corresponding and respective inward and outward surfaces, and said door assembly comprising:

a door support panel including a first wall mounting sheath surrounding a wall mounting side of said door support panel for providing an adjustable mounting width for said door support panel;

a first door panel including a first hinge for hingably coupling said first door panel with said door support panel to swing inwardly relative to said door support panel;

a second door panel including a second hinge for hingably coupling said second door panel with said first door panel to swing outwardly relative to said first door panel; and a closure panel including a second wall mounting sheath surrounding a wall mounting side of said door closure panel, for providing an adjustable mounting width for said door closure panel to permit the unhinged edge of said second door panel to close against an edge of said door closure panel opposite said wall mounting side of said door closure panel, said first and second door panels each including an inwardly protruding lower spray deflector section with a bottom edge extending over a bottom edge of a shower alcove when said door panel assembly is closed, said door support and closure panels each including a spray deflector shield extending from an edge thereof adjacent said spray deflector section inwardly to approximate the surface of each spray deflector section when said door assembly is closed.

5. The door assembly recited in claim 4, wherein each of said door support panels include a sealing strip along each of its butting surfaces.

6. The door assembly recited in claim 5, wherein said sealing strips are magnetically attractive.

* * * * *